US011189473B2

(12) United States Patent
Rottmann et al.

(10) Patent No.: US 11,189,473 B2
(45) **Date of Patent: *Nov. 30, 2021**

(54) MASS SPECTROMETER

(71) Applicant: Thermo Fisher Scientific (Bremen) GmbH, Bremen (DE)

(72) Inventors: Lothar Rottmann, Bremen (DE); Alexander Makarov, Bremen (DE); Hans-Juergen Schlueter, Krailing (DE); Christoph Wehe, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/852,402

(22) Filed: Apr. 17, 2020

(65) Prior Publication Data

US 2020/0251317 A1 Aug. 6, 2020

Related U.S. Application Data

(63) Continuation of application No. 15/260,622, filed on Sep. 9, 2016, now Pat. No. 10,665,438.

(30) Foreign Application Priority Data

Sep. 17, 2015 (GB) ..... 1516508

(51) Int. Cl.
*H01J 49/00* (2006.01)
*H01J 49/42* (2006.01)

(52) U.S. Cl.
CPC ..... *H01J 49/0009* (2013.01); *H01J 49/005* (2013.01); *H01J 49/0031* (2013.01); *H01J 49/0045* (2013.01); *H01J 49/4215* (2013.01)

(58) Field of Classification Search
CPC ..... H01J 49/0009; H01J 49/0031; H01J 49/0036; H01J 49/005; H01J 49/4215; H01J 49/004
See application file for complete search history.

(56) References Cited

U.S. PATENT DOCUMENTS 4,933,547 A * 6/1990 Cody, Jr. ..... H01J 49/0009 250/282
6,140,638 A * 10/2000 Tanner ..... H01J 49/005 250/282

(Continued)

FOREIGN PATENT DOCUMENTS

EP 1114437 B1 1/2010
GB 2391383 C 6/2005

(Continued)

OTHER PUBLICATIONS

Douglas, "Some Current Perspectives on ICP-MS," Canadian Journal Spectroscopy, 34(2), 38-49, 1989.

(Continued)

*Primary Examiner* — Wyatt A Stoffa

(57) ABSTRACT

An elemental mass spectrometer uses a mass filter to select ions from ions received from an ion source and transmit the selected ions. A reaction or collision cell receives the transmitted ions and reacts or collides these with a gas to provide product ions thereby. A mass analyzer receives the product ions, analyzes them and provides at least one output based on detection of the analyzed ions. The elemental mass spectrometer is operated to provide a first output from the mass analyzer measuring ions within a first analysis range of mass-to-charge to provide a second output from the mass analyzer measuring ions within a second analysis range of mass-to-charge ratios and to correct the first output for interference on the basis of the second output.

25 Claims, 8 Drawing Sheets

(56) References Cited

U.S. PATENT DOCUMENTS 6,875,618 B2 4/2005 Bandura et al.
7,047,144 B2 * 5/2006 Steiner ..... H01J 49/0027 702/64
7,202,470 B1 4/2007 Marriott
7,230,232 B2 6/2007 Marriott
7,339,163 B2 3/2008 Marriott
7,501,621 B2 * 3/2009 Willis ..... H01J 49/0036 250/281
7,842,919 B2 11/2010 Shiokawa
7,982,180 B2 * 7/2011 Shilov ..... H01J 49/004 250/281
8,455,818 B2 * 6/2013 Coon ..... H01J 49/004 250/290
8,610,053 B2 12/2013 Yamada et al.
8,658,971 B2 * 2/2014 Green ..... G06K 9/0053 250/287
8,759,752 B2 * 6/2014 Remes ..... H01J 49/0036 250/282
8,803,083 B2 * 8/2014 Goldberg ..... H01J 49/40 250/287
8,969,791 B2 * 3/2015 Mukaibatake ..... H01J 49/26 250/252.1
9,043,164 B2 * 5/2015 Makarov ..... G16C 20/20 702/27
9,053,911 B2 * 6/2015 Green ..... G06K 9/0053
9,117,638 B2 * 8/2015 Aiello ..... G01N 27/622
9,324,545 B2 * 4/2016 Green ..... H01J 49/022
9,558,922 B2 * 1/2017 Anderson ..... H01J 49/0036
9,812,313 B2 * 11/2017 Grothe, Jr. ..... H01J 49/0031
10,403,486 B2 * 9/2019 Scott ..... H01J 49/0036
2004/0024552 A1 * 2/2004 Bowdler ..... H01J 49/0009 702/89
2004/0026610 A1 * 2/2004 Abou-Shakra ..... H01J 49/105 250/281
2005/0023454 A1 * 2/2005 Bateman ..... H01J 49/0036 250/288
2005/0139763 A1 * 6/2005 Nagai ..... H01J 49/0009 250/287
2006/0045207 A1 * 3/2006 Cheng ..... H01J 49/0036 375/317
2007/0203652 A1 * 8/2007 Horning ..... H01J 49/38 702/19
2008/0067346 A1 * 3/2008 Amster ..... H01J 49/0009 250/282
2008/0224033 A1 * 9/2008 Makarov ..... H01J 49/04 250/287
2010/0114498 A1 * 5/2010 Park ..... H01J 49/0036 702/19
2010/0213361 A1 * 8/2010 Green ..... H01J 49/0036 250/252.1
2010/0213368 A1 * 8/2010 Wang ..... H01J 49/0036 250/282
2010/0280764 A1 * 11/2010 Thomson ..... H01J 49/0009 702/23
2011/0165694 A1 7/2011 Krumwiede et al.
2012/0058009 A1 3/2012 Nogami et al.
2012/0085900 A1 * 4/2012 Verbeck, IV ..... G01N 21/65 250/282
2013/0084645 A1 * 4/2013 Coon ..... H01J 49/04 436/173
2013/0214146 A1 * 8/2013 Okumura ..... H01J 49/004 250/281
2013/0234014 A1 * 9/2013 Remes ..... H01J 49/0036 250/282
2013/0277542 A1 * 10/2013 Sasaki ..... H01J 49/0009 250/252.1
2014/0051181 A1 * 2/2014 Brown ..... H01J 49/0495 436/173
2014/0097338 A1 * 4/2014 Eiler ..... H01J 49/04 250/282
2014/0117219 A1 * 5/2014 Kenny ..... H01J 49/0031 250/252.1
2014/0299762 A1 * 10/2014 Mukaibatake ..... H01J 49/26 250/283
2014/0361158 A1 * 12/2014 Remes ..... H01J 49/4265 250/282
2015/0144778 A1 * 5/2015 Bonner ..... H01J 49/0031 250/282
2015/0187555 A1 * 7/2015 Hirano ..... H01J 49/061 250/288
2015/0221488 A1 * 8/2015 Hyeon ..... H01J 49/164 250/282
2015/0293058 A1 * 10/2015 Wuhr ..... G01N 33/68 436/173
2016/0035551 A1 * 2/2016 Green ..... H01J 49/4215 250/282
2016/0042937 A1 * 2/2016 Remes ..... H01J 49/0031 250/283
2016/0133450 A1 * 5/2016 Green ..... H01J 49/0036 250/282
2016/0154006 A1 * 6/2016 Hermanson ..... G01N 33/60 506/12
2016/0217985 A1 * 7/2016 Makarov ..... H01J 49/0036
2016/0240359 A1 * 8/2016 Kenny ..... H01J 49/40
2016/0336161 A1 * 11/2016 Grothe, Jr. ..... H01J 49/40
2017/0047208 A1 * 2/2017 Brown ..... H01J 49/0009
2017/0117123 A1 * 4/2017 Geromanos ..... H01J 49/0036
2017/0125222 A1 * 5/2017 Brown ..... H01J 49/0036
2017/0285042 A1 * 10/2017 Coon ..... H01J 49/26
2017/0336374 A1 * 11/2017 Guzzonato ..... G01N 30/62
2018/0025898 A1 * 1/2018 Grothe, Jr. ..... H01J 49/025 250/282
2020/0043713 A1 * 2/2020 Makarov ..... H01J 49/105
2020/0266042 A1 * 8/2020 Geromanos ..... H01J 49/0031

FOREIGN PATENT DOCUMENTS

GB 2523222 A 8/2015
JP 2001311720 A 11/2001
JP 2015137684 A 7/2015
WO WO-0101446 A1 1/2001
WO WO-2014181396 A1 11/2014

OTHER PUBLICATIONS

Examination Report dated Sep. 18, 2018, to GB Patent Application No. 1516508.7.
Final Rejection dated May 14, 2019, to U.S. Appl. No. 15/260,622.
Jemal, Mohammed, et al. "A strategy for metabolite identification using triple- quadrupole mass spectrometry with enhanced resolution and accurate mass capability." Rapid communications in mass spectrometry 17.24 (2003): 2732-2740.
Non-Final Rejection dated Aug. 27, 2019, to U.S. Appl. No. 15/260,622.
Non-Final Rejection dated May 2, 2018, to U.S. Appl. No. 15/260,622.
Taylor, "Inductively coupled plasma-mass spectrometry practices and techniques," Academic Press, 2001, pp. 125-136.

* cited by examiner

MASS SPECTROMETER

CROSS-REFERENCE TO RELATED APPLICATION

This application is a continuation of U.S. patent application Ser. No. 15/260,622, filed on Sep. 9, 2016. U.S. patent application Ser. No. 15/260,622 claims the priority benefit under 35 U.S.C. § 119 to British Patent Application No. 1516508.7, filed on Sep. 17, 2015, the disclosure of which is incorporated herein by reference.

TECHNICAL FIELD OF THE INVENTION

The invention relates to an elemental mass spectrometer, especially one based on a triple quadrupole mass analyzer, and a method of operating an elemental mass spectrometer.

BACKGROUND TO THE INVENTION

The triple quadrupole mass spectrometer is a well-known and widely used instrument for targeted analysis of complex mixtures, using molecular ion sources such as electrospray, atmospheric-pressure chemical ionization and others. In these instruments, precursor ions of a specific range of mass-to-charge (m/z) ratios are selected by one quadrupole analyzer (Q1), fragmented in a gas-filled collision cell (Q2) and then one or more particular fragments are selected by a second quadrupole analyzer (Q3). This allows filtering out only desired precursor ions and corresponding fragment ions of interest. Thus, a robust, quantitative method for targeted analysis is provided, where the targets for analysis are known but are present at very low levels comparing to other analytes.

It is also known that such instruments can be successfully applied to elemental analysis, which may use a range of ion sources, including: Inductively Coupled Plasma (ICP); glow discharge (GD); Microwave Induced Plasma (MIP); and others. A triple-quadrupole ICP mass spectrometry system has several advantages compared to those equipped with only one "full resolution" quadrupole (resolution depends on mass, but generally in the range of about 300 with peak widths in the range of 0.7-0.8 amu) and a collision or reaction cell, which might therefore be termed a dual-quadrupole device. In the triple-quadrupole, the quadrupole located upstream the collision or reaction cell allows selection of a limited set of ions, according to their m/z ratio, to undergo reactions inside the collision/reaction cell.

In one approach, the collision cell ($Q_2$) operates as a reaction cell, filled with reactive gases such as oxygen ($O_2$) or ammonia ($NH_3$). Alternatively, the collisional cell ($Q_2$) can be used in collision mode with an inert gas (such as He), other reactive gases (for example, H) or mixtures (H+He, for instance).

Some implementations based on these principles may react the interfering ions to another mass (or achieve this by collision), while the desired ions are left alone and can therefore be selected and detected in the Q3 analyzer. Examples of this are detailed in U.S. Pat. Nos. 7,202,470, 7,230,232 and 7,339,163. Alternatively, the desired ions may be reacted or collided to another mass, while the interfering ions are left alone. The Q3 analyzer may then be used to select and detect the desired ions at a different mass (a higher mass in the case of reaction) than the Q1 analyzer. Examples of such configurations are described in "Some Current Perspectives on ICP-MS," D. J. Douglas, Canad. J. Spectrosc., V. 34, No. 2, 1989, U.S. Pat. No. 6,875,618, GB-2391383, WO-01/01446 and U.S. Pat. No. 8,610,053.

When the Q2 cell is operated in reaction mode, different element or adduct ions may react with the reaction cell gases at vastly different rates. Hence, if isotopes or adducts of different elements appear in the same mass window after being selected by Q1, the desired element ions could be further transformed in Q2, for instance into adduct products ($[A+O]^+$ or $[A+NH^3]^+$, etc.), while the isotopes or adducts of interfering elements will typically remain at the same m/z ratio. In principle, the second quadrupole analyzer (Q3) can then select a product of interest and thus provides interference-free output from the detector.

However, achieving such reduced interference demands a significant complication of the instrument layout in comparison with a traditional single-quadrupole analyzer. It is suggested in U.S. Pat. No. 8,610,053 that this is caused by the necessity to add an analytical-quality Q1, requiring tight vacuum conditions to operate with unit mass resolution. Such an instrument is complex and expensive. It would be desirable to use a lower-resolution Q1, having lower vacuum requirements, but without causing increased interference or reducing abundance sensitivity.

SUMMARY OF THE INVENTION

Against this background, there is provided an elemental mass spectrometer in accordance with claim 1 and a method of operating an elemental mass spectrometer (or a method of elemental mass spectroscopy) in line with claim 24. The method may be implemented using a computer program and such a computer program is also provided in line with claim 25. However, it will be recognized that the method can be implemented using any one or more of: hardware; firmware; programmable logic; application specific circuitry; and software. Preferred and advantageous features of the invention are further defined in the claims.

In summary, a triple quadrupole mass spectrometer (or more generally, an MS/MS mass spectrometer, for example if other analyzers are used instead of or in addition to the third quadrupole, although the third, analysis stage, will be labelled Q3 herein for convenience, even if an analyzer other than a quadrupole is used) is operated for elemental analysis. A first output is provided by Q3 analyzing an m/z band set to include a desired mass-to-charge ratio, M. Additionally, a second output is provided by Q3 analyzing an m/z band set to include a mass-to-charge ratio at least 0.9, 0.95, 0.96, 0.97, 0.98, 0.99 or 1 atomic mass unit (amu) lower than the desired mass-to-charge ratio, that is (M−i), i≥0.95 or 1 (or another value detailed herein). Typically, an initial further operation has the Q3 m/z band set to include (M−1). Optionally, a subsequent further operation has the Q3 m/z band set to include (M−2). The first output is corrected using the second output. Such an approach may be especially useful where the reaction or collision cell gas is polyisotopic and/or at least some of the ions are polyisotopic (particularly interfering ions, but possibly wanted ions alternatively or in addition).

Using this approach, it may be possible to correct an ion detector measurement for M, using outputs of the ion detector for masses lower than M, for example using the ion detector measurement for (M−1) and optionally also using the ion detector measurement for (M−2). The approach taken by the invention may allow the m/z band transmitted by the first stage (Q1) to be greater than 1 amu and possibly several amu (1.5, 2, 3, 4, 5, 10 amu or more in embodiments). In embodiments, introduction ion optics and the first stage (Q1) can be operated at substantially the same pressure. Advantageously, Q1 may be short, low-resolution, operate at an inferior vacuum and/or be small in size without increasing interference or reducing abundance sensitivity.

Preferably, the width of the m/z bands analyzed for the first output and second output are each set to allow detection of a single product, for example each being no wider than 1 amu. The preferred embodiment uses a triple quadrupole mass spectrometer and then, the third stage (Q3) may be set to transmit ions within an m/z band no wider than 1 amu. The elemental mass spectrometer may then be operated multiple times in order to analyze a single sample, with a first operation being used to provide the first output and a second operation providing the second output. Alternatively, the use of some mass analyzers may permit the first and second outputs to be provided by a single operation of the elemental mass spectrometer.

An interference level may be determined based on the ion detector output from the second output (and optionally, third or further outputs analyzing other m/z ratios lower than M). This may be used for the correction. However, if the proportion of the interference level relative to the first output is at least a threshold level (for example, 30%, 40%, 50%, 60%, 70%, 80% or 90%), an updated first output is provided with at least one difference from the original first output. In particular, the Q3 m/z band analyzed for the updated first output may be set to include M, but to be different from the Q3 m/z band used for the first output (for example, the Q3 m/z band may be adjusted). The updated first output may be used instead of the first output, provided that the proportion of the interference level to the updated first output now meets the threshold level (otherwise, one or more further updated first outputs may be provided with an increased adjustment each time until the proportion of the interference level to the updated first output now meets the threshold level). Generally, the adjustment to the Q3 m/z analysis band for the updated first output is small (less than 0.5 amu, typically 0.3 amu). In most cases, the adjustment moves the Q3 m/z analysis band to a higher range (that is, higher masses now fall within the range), but where the reaction gas has a low molecular mass (especially relative to the Q1 m/z band-pass width), the adjustment may move the Q3 m/z analysis band to a lower range (such that lower masses now fall within the range).

BRIEF DESCRIPTION OF THE DRAWINGS

The invention may be put into practice in a number of ways, and a preferred embodiment will now be described by way of example only and with reference to the accompanying drawings, in which.

DETAILED DESCRIPTION OF A PREFERRED EMBODIMENT

Figure 1:
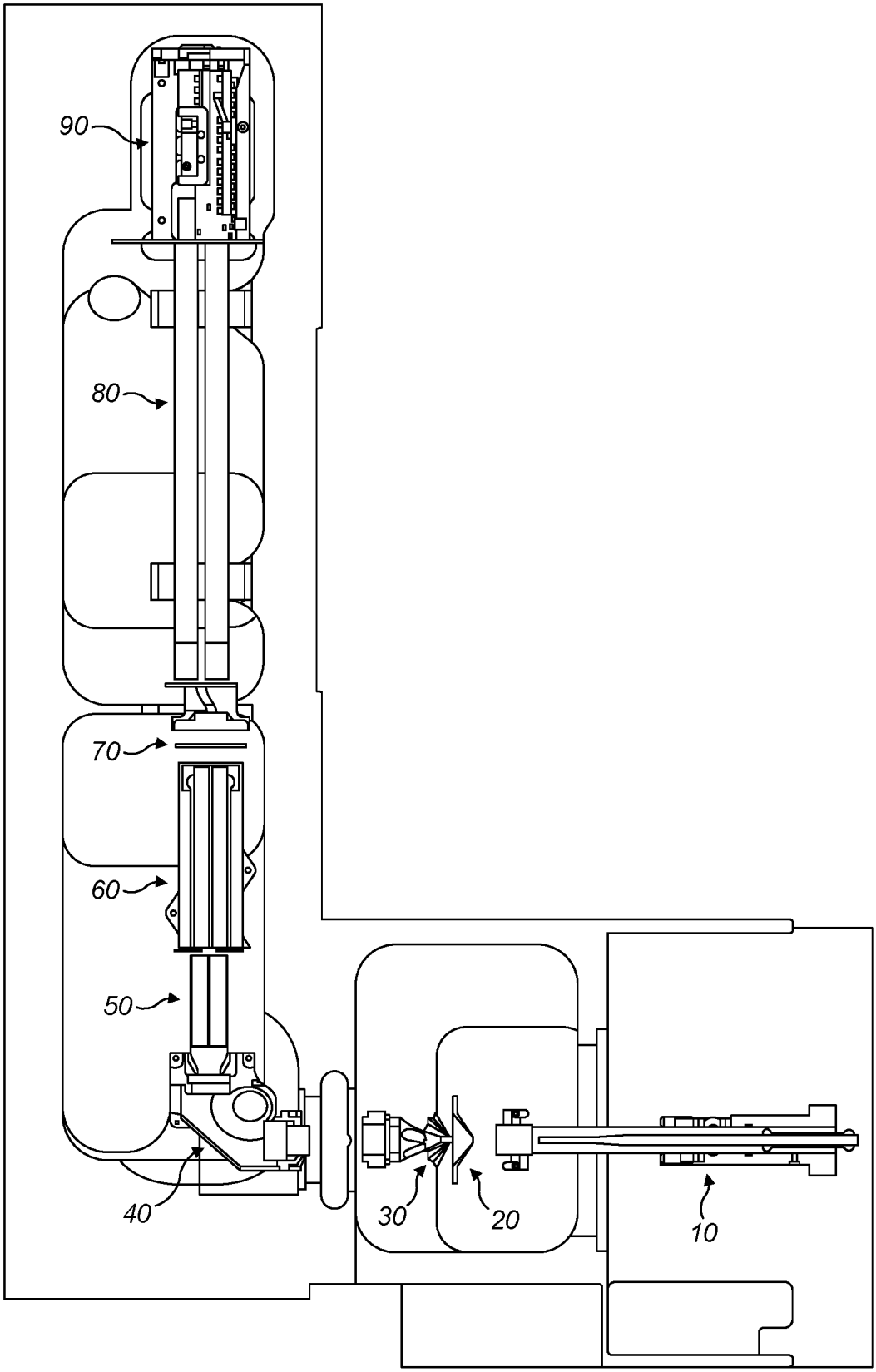
FIG. 1 depicts a schematic embodiment of an ICP mass spectrometer which can be operated in accordance with the invention.

Referring first to FIG. 1, there is depicted a schematic embodiment of a ICP mass spectrometer, comprising: an ICP torch 10; a sampler cone 20; a skimmer cone 30; ion optics 40; a first (Q1) mass filter 50; a reaction cell (Q2) 60; a differentially pumped aperture 70; a second (Q3) mass filter 80; and an ion detector 90. The Q3 mass filter 80 may be considered a mass analyzer or a part of a mass analyzer. In this preferred embodiment, ions are produced in the ICP torch 10, introduced into vacuum via sampler 20 and skimmer 30, transported through (bending) ion optics 40 and selected by Q1 quadrupole mass filter 50. It will be noted that Q1 mass filter 50 is relatively short in comparison with Q2 reaction cell 60 and Q3 mass filter 80, and is schematically depicted so. Moreover, the vacuum conditions of the Q1 mass filter 50 are less demanding than for the subsequent stages. Here, the ion optics 40 and Q1 mass filter 50 are operated at substantially the same pressure. Ions of the selected mass range pass into the quadrupole reaction cell 60 and the reaction product is directed through ion optics and differentially pumped aperture 70 into the analytical quadrupole mass filter Q3 80 and detected by high dynamic range detector 90, for example an SEM. The Q3 mass filter 80 is highly selective (especially in comparison with the Q1 mass filter 50), and has a band-pass width of typically no greater than 1 amu. A controller (not shown) operates the spectrometer. The controller typically comprises a computer processor. A computer program, when executed by the processor, enables control of the spectrometer so as to operate in accordance with the method of the invention.

Figure 2:
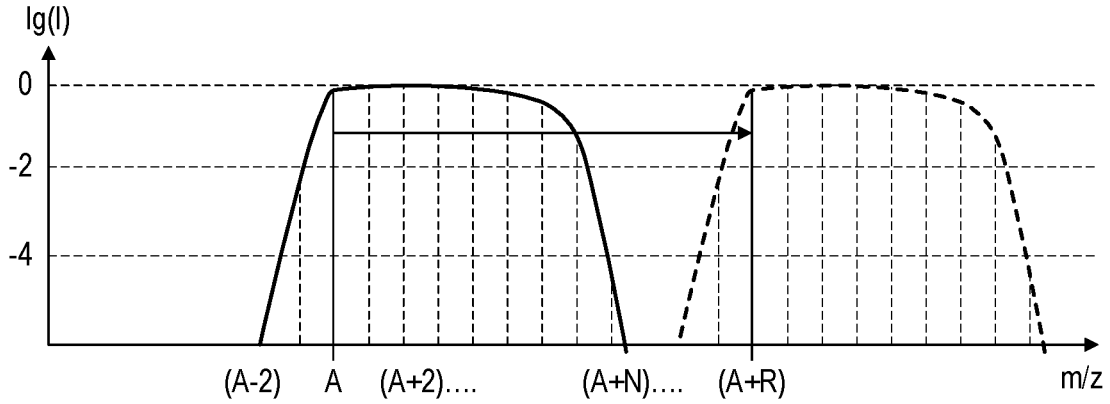
FIG. 2 illustrates a sample plot of intensity against mass for the outputs of a first analyzer stage and a reaction cell of the mass spectrometer of FIG. 1, in a first use case.

Referring to FIG. 2, there is illustrated a sample plot of intensity against mass for the outputs of the first mass filter 50 (solid line) and the reaction cell 60 (dashed line) of the mass spectrometer, in a first case. For the Q1 mass filter 50 output, the plot can also be termed an isolation peak. The intensity is plotted on a logarithmic scale. In this plot, A indicates the nominal m/z ratio of interest and the Q1 mass filter 50 is set for generally maximum (as close as reasonably possible to 100%) transmission of this mass. Due to the short length and lower vacuum of Q1 mass filter 50, not only are ions of the mass of interest A transmitted, but also adjacent masses (A−2), (A−1), (A+1) . . . (A+N) are transmitted. Nevertheless, lower masses are usually significantly attenuated (by 2 to 3 orders of magnitude or more) by the Q1 mass filter 50. The pass-band width of the Q1 mass filter 50 can therefore be defined as Nor optionally N+2.

After reaction in the Q2 cell 60, the isolation peak is shifted to a higher m/z ratio by the m/z ratio of reactant gas, R, to mass M=A+R. In FIG. 2, all ion-molecule reactions for all species within the isolation peak are 100% efficient, so that the intensity profile for the reaction cell 60 output has the same size and shape as the intensity profile for the Q1 mass filter 50 output. This is an example only, since such a level of efficiency will not usually be possible. Then, ions of mass M=(A+R) are selected for analysis by Q3 mass filter 80 and subsequent detection. It can be seen here that the mass of the reactant gas (or at least its effect on the m/z ratio of the product) is greater than the pass-band width of the Q1, such that R>N and preferably R>N+2. The detection signal from the selected ions of mass M=(A+R) is then used to determine the original concentration of analyte A. In general, this can be found using elemental analysis techniques that are well known to the skilled person. However, the pass-band width of the Q1 mass filter 50 can cause problems, as will now be discussed.

The reaction gas used is typically not monoisotopic. For example, $NH_3$ contains 0.37% of $^{15}N$ and 0.016% of $^{2}H$, oxygen contains 0.2% $^{18}O$ and 0.038% $^{17}O$. Hence in the Q1 mass filter 50 output, another mass peak at mass (A−1) could produce an interference at mass M=(A+R) where R is the nominal mass of reaction adduct (R=17 for $NH_3$ and R=16 for $O_2$). The intensity of this interference can be quantified by the following expression:

$$\text{Interference}(A+R) = \sum_i I(A-i)\cdot P_{rel}(A-i)\cdot I_{rel}(R+i)$$

where: $P_{rel}(A-i)$ is the relative transmission of mass i units lower than mass of interest, A (as shown with reference to FIG. 2); I(A−i) is the absolute intensity of signal at mass (A−i); and $I_{rel}(R+i)$ is relative intensity of the reaction gas adduct at mass i units higher than its monoisotopic mass R. For the two gases considered above (oxygen and ammonia), i>2 can be neglected completely and only i=1, 2 should be considered. In practice, $P_{rel}(A-i)$ and $I_{rel}(R+i)$ are known and I(A−i) can be measured by experiment. This will be discussed in more detail below.

Figure 3:
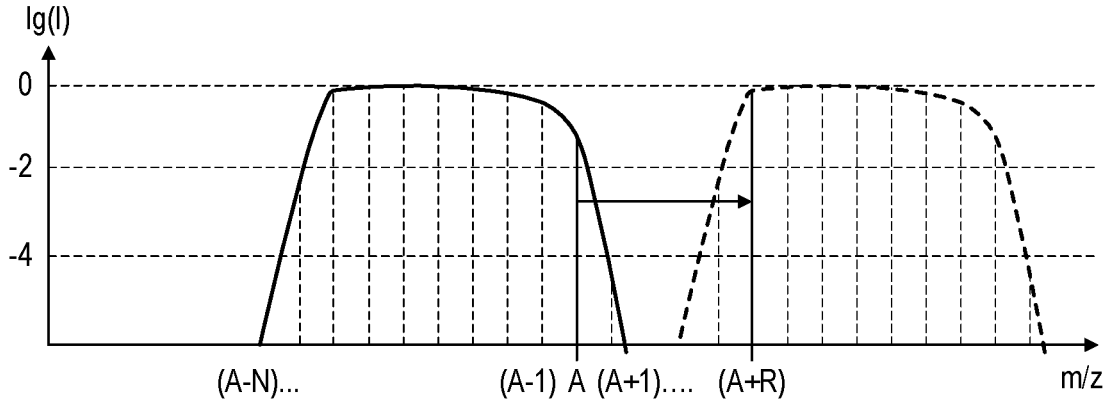
FIG. 3 illustrates a sample plot of intensity against mass for the outputs of a first analyzer stage and a reaction cell of the mass spectrometer of FIG. 1, in a second use case.

Referring next to FIG. 3, there is illustrated a sample plot of intensity against mass for the outputs of the first mass filter 50 (solid line) and the reaction cell 60 (dashed line) of the mass spectrometer, in a second case. Here the mass of the reactant gas (or a component of the reactant gas) is not greater than (and preferably is less than) the pass-band width of the Q1, such that R≤N (preferably R<N).

Figure 4:
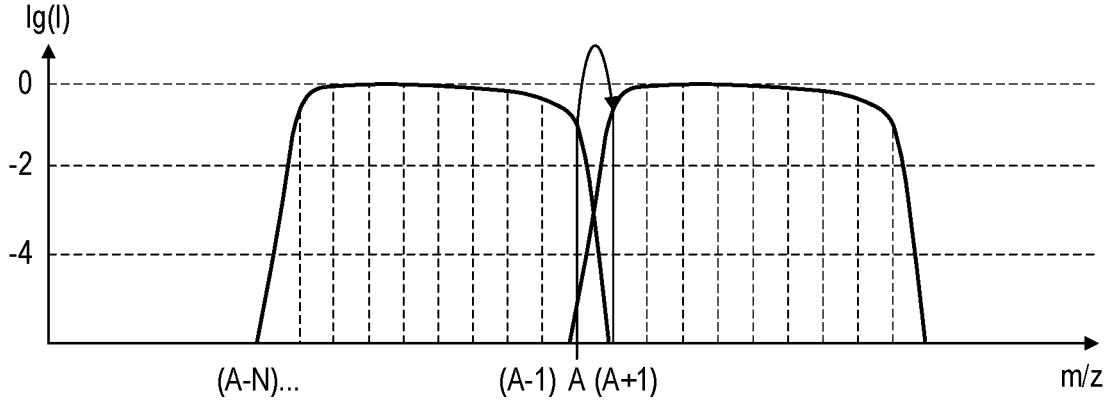
FIG. 4 illustrates a sample plot of intensity against mass for the outputs of a first analyzer stage and a reaction cell of the mass spectrometer of FIG. 1, in a third use case.

Referring now to FIG. 4, there is illustrated a sample plot of intensity against mass for the outputs of the first mass filter 50 (solid line) and the reaction cell 60 (dashed line) of the mass spectrometer, in a third case. In both FIGS. 3 and 4, the reaction gas has a low molecular mass and in the particular example of FIG. 4 Hydrogen is used, which also has a component with a low atomic mass. Thus, in this case, the component hydrogen atom is relevant, such that R=1 and i=1. As a result, not only the mass of interest A, but the entire window (A−N), . . . (A−2), (A−1) . . . (A+R−1) can be transmitted through Q1 mass filter 50. Nevertheless, ions of mass (A+R) are significantly attenuated (by more than 2 to 3 orders of magnitude) by Q1 mass filter 50. It will especially be noticed that the isolation window for the Q1 mass filter 50 for the use case shown in FIG. 4 is more rectangular than for other use cases, which is desirable to avoid significant loss of transmission.

In cases where the mass of the reactant gas or a component of the reactant gas is low, the expression above for interference is still applicable, but the position of A within the isolation window changes as shown in FIG. 3 and FIG. 4. It moves from the low-mass edge of the Q1 transmission window to its high-mass edge. Only the case of very high intensity interference at mass (A+1) may not be addressed by this approach.

Due to the very high dynamic range of ICP-MS, the initial intensity of peaks at masses (A−1) and (A−2) prior to the Q1 mass filter 50 may theoretically be up to 5 or 6 orders of magnitude higher than at mass A. A matrix signal may be present in the mass analysis. Matrix peaks usually reach saturation at currents equivalent to 100s of ppm, while detection limits for the analyte usually reach sub-ppt. If the matrix has a concentration at 100-500 ppm or higher, its current is saturated by space charge and stays roughly at the level corresponding to 100 ppm (for instance $2*10^8$ ions/sec/ppm corresponds with a current of $2*10^{10}$ ions/sec, while a 1 ppt signal would give a current of $2*10^2$ ions/sec). For such extreme cases and for potentially the most difficult case of ammonia, interference could be made smaller than the analyte signal if $2.5*10^{-4}<P_{rel}(A-1)<2.5*10^{-3}$. For oxygen, $2.5*10^{-3}<P_{rel}(A-1)<2.5*10^{-2}$. If original ions of the matrix at mass (A−1) completely react with oxygen (R=16), then the detection limits are defined by a signal of intensity $2*10^{10}$ for the base isotope of oxygen at mass (A+R−1) and a corresponding signal of intensity $2*10^4$ for $^{17}O$ at (A+R) (for the relative abundance of this isotope as detailed above and $P_{rel}=2.5*10^{-3}$) which is equivalent to 100 ppt. If the matrix were not so super-intense (low ppm are more typical), $P_{rel}=2.5*10^{-2}$ would be already sufficient for most practical cases.

If this condition is fulfilled, then $P_{rel}(A-2)$ will be sufficiently small so that measurement of $I(A-2)\cdot P_{rel}(A-2)$ is unnecessary for the interference level to be determined with sufficient accuracy. While such values are actually quite conservative for quadrupole mass filters, they might be difficult to reach for a short, low-performance quadrupole operating at higher pressure, such as Q1 mass filter 50 of the embodiment shown in FIG. 1.

In order to avoid erroneous results and as outlined above, it is therefore proposed to add to the normal mode of operation an additional quality control operation: acquisition not only of signal (a first output) at mass (A+R), but also (a second output) at (A+R−1) and, in some cases (a third output), for (A+R−2). Such measurement could be achieved with at least an order of magnitude less dwell time than for the analyte as it makes sense only if signals at these masses are much more intense than at mass of the analyte. This would give direct reading of $I(A-i)\cdot P_{rel}(A-i)$, while the remaining term $I_{rel}(R+i)$ is known for a given reactant gas (i=1, 2). If a panoramic analyzer (for instance, time-of-flight, electrostatic trap analyzer such as one of the orbital trapping type) is used instead of or in addition to Q3, these signals could be acquired simultaneously.

The correction of the first output can therefore be accomplished. The intensity is measured at (A+R−1), to provide the second output. This allows an intensity to be established for reaction of the element of interest with the base (usually most intense) isotope of the reaction gas, such as $^{16}O$ (R=16). As $^{17}O$ is naturally abundant at a proportion of $3.8*10^{-4}$ relative to this base isotope, it means that the intensity of the interference as a component of the signal of interest (the first output) at (A+R) is 3.8e−4 of what was measured at (A+R−1). Therefore the interference intensity is subtracted from the measurement at (A+R). For the case of oxygen, there is also $^{18}O$ which is naturally abundant at a proportion of $2.05*10^{-4}$ relative to the base isotope, so a signal (a third output) is also measured at (A+R−2) and used to correct the first output, as this component could also give strong input into the signal at (A+R).

If the calculated interference does not constitute the majority of signal detected for mass (A+R) (for example, a threshold of 80% could be chosen for its share in the total signal), then the measured signal at that mass could be corrected and used for analytical measurements.

Otherwise, this measurement should be discarded and the isolation window in Q1 is moved by a small increment (typically, 0.3 amu). For the case shown FIG. 2 (where a mass of the reaction gas is higher than the Q1 band-pass width), this adjustment is to higher masses, in order to reduce $P_{rel}(A-1)$ at the expense of analyte transmission at mass A. Typically, this could reduce $P_{rel}(A-1)$ by 1-2 orders of magnitude, while the signal at mass A would fall by factor 2-5. For the case of FIG. 3 (where the molecular mass of the reaction gas is no higher than the Q1 band-pass width), the isolation window should be moved instead to lower masses in order to reduce $P_{rel}(A+1)$. If this adjustment of the isolation window does not help, then alternative methods for analyte measurement can be selected (such as alternative reaction gas, isotopically clean reaction gas or similar).

Hence in general terms, this can be considered a mass spectrometer, particularly an elemental mass spectrometer, comprising: an ion source for generating ions (for example, an ICP); a mass filter, arranged to receive ions generated by the ion source, to select ions of a filter range of mass-to-charge ratios from the received ions and to transmit the selected ions; a reaction or collision cell, configured to receive ions transmitted by the mass filter and to react the received ions with a gas and provide or generate product ions thereby; a mass analyzer, arranged to receive the product ions from the reaction or collision cell and analyze the received ions within one or more analysis ranges of mass-to-charge ratios; and a controller. The mass analyzer is particularly configured to provide at least one output based on detection of the analyzed ions. The controller is especially configured to operate the elemental mass spectrometer, so as to provide a first output (from the mass analyzer) measuring ions within a first analysis range of mass-to-charge ratios including a desired mass-to-charge ratio, M, and to provide a second output (from the mass analyzer) measuring ions within a second analysis range of mass-to-charge ratios including a mass-to-charge ratio at least 0.95 atomic mass units lower than the desired mass-to-charge ratio, (M−i), i≥0.95. The controller is then further beneficially configured to correct the first output on the basis of the second output.

Along the same lines, there may also be provided a method of operating a mass spectrometer, particularly an elemental mass spectrometer (or a method of mass spectroscopy, mass spectrometry, elemental mass spectroscopy or elemental mass spectrometry), comprising: performing at least one operation of the elemental mass spectrometer. Each operation may comprise the steps of: generating ions in an ion source; selecting ions of a filter range of mass-to-charge ratios from the ions generated by the ion source, at a mass filter, and transmitting the selected ions; reacting or colliding ions transmitted by the mass filter with a gas at a reaction or collision cell, to provide or generate product ions thereby; and analyzing the product ions within a plurality of analysis ranges of mass-to-charge ratios at a mass analyzer. Then, a first output measuring ions within a first analysis range of mass-to-charge ratios including a desired mass-to-charge ratio, M is advantageously provided. A second output is beneficially further provided, measuring ions within a second analysis range of mass-to-charge ratios including a mass-to-charge ratio at least 0.95 atomic mass unit lower than the desired mass-to-charge ratio, (M−i), i≥0.95. The first output may thereby be corrected on the basis of the second output.

A wide range of optional and preferable features may be applied to either or both of the elemental mass spectrometer and the method and any features described herein with respect to one may equally be applied to the other. For example, the filter range of mass-to-charge ratios is preferably wider than 1 atomic mass unit.

In some cases, the elemental mass spectrometer may be operated to provide a third output measuring ions within a third analysis range of mass-to-charge ratios. The third analysis range includes a mass-to-charge ratio at least 0.95 atomic mass units lower than the desired mass-to-charge ratio, (M−i), i≥0.95. Beneficially the first output is corrected on the basis of the second output and the third output. The third analysis range of mass-to-charge ratios is advantageously different from the second analysis range of mass-to-charge ratios and typically has an upper bound at least 0.95 amu lower than the upper bound of the second analysis range of mass-to-charge ratios, for example such that the second analysis range may cover (M−i) and the third analysis range may cover (M−2i), especially when i is approximately 1.

In the preferred embodiment, each of the one or more analysis ranges of mass-to-charge ratios is no wider than 1 atomic mass unit and more preferably, the mass analyzer has a band-pass mass width that is no wider than 1 atomic mass unit. The first output is preferably provided by a first operation of the elemental mass spectrometer with the mass analyzer configured to analyze received ions within the first analysis range of mass-to-charge ratios (less than 1 amu in width) and the second output being provided by a second operation of the elemental mass spectrometer with the mass analyzer configured to analyze received ions within the second analysis range of mass-to-charge ratios (less than 1 amu in width). The second output may therefore be provided a further operation of the elemental mass spectrometer. This further operation (and other further operations to provide third or more outputs) typically occurs subsequent to the first operation, although this is not strictly necessary. Typically, the reaction or collision cell is configured to react or collide the received ions with a polyisotopic gas and/or at least some of the received ions are polyisotopic. Additionally or alternatively, the gas may give rise to a plurality of adduct (or product) ions having different m/z ratio, for example when ammonia is used as a reaction gas. In such cases, it may not always be possible to identify all of the desired ions received at the second mass filter (Q3 stage) immediately, since isotopes having a m/z ratio slightly different from that of the desired ions may cause adduct (or product) ions having a m/z ratio that is not readily distinguishable from the m/z ratio of the adduct (or product) ions generated by the desired ions.

In another embodiment, the mass analyzer is arranged to perform a single analysis of the received ions within a range of mass-to-charge ratios having a width of at least 1 atomic mass unit. The first output and second output (and optionally third or more outputs) may then be provided on the basis of the single analysis.

One or more (and more preferably, all) of: the first mass filter; the second mass filter; and the reaction or collision cell may comprise a monopole ion optical device or more preferably, a multipole ion optical device, such as a quadrupole, hexapole or octapole ion optical device (although an octapole ion optical device may generally only be used as a reaction or collision cell). In some embodiments, the mass analyzer comprises a time-of-flight or distance-of-flight mass analyzer, an RF trap, an ion mobility filter, a magnetic sector, an electrostatic trap analyzer or an orbital trapping mass analyzer. The mass analyzer may comprise: a mass selection device, configured to select ions of the one or more analysis ranges of mass-to-charge ratios from the received product ions and to transmit the selected ions (such as a multipole ion optical device, time-of-flight mass selection device, electrostatic trap or similar); and an ion detector, arranged to detect ions transmitted by the mass selection device.

The first output (when the first analysis range of mass-to-charge ratios includes M) is therefore corrected, using the second output (and optionally third or further outputs). Optionally, an interference level is determined based on the second output (and optionally third or further outputs). This interference level is beneficially used to correct the first output or provide an updated first output (as will now be detailed).

It may be identified if the interference level relative to the first output is at least a threshold level. If the threshold level is met, an operation of the elemental mass spectrometer is performed to provide an updated first output (which may be an additional operation in the preferred embodiment). At least one parameter in respect of the updated output is typically different from the corresponding parameter in respect of the first output. Then, the first output may be corrected, by correcting the updated first output on the basis of the second output. For the updated first output, an updated first analysis range of mass-to-charge ratios is optionally used, which is set to include M, but is different from the first range of mass-to-charge ratios used for the first output. For example, a lower bound of the updated first analysis range of mass-to-charge ratios set may be higher than a lower bound of the first analysis range of mass-to-charge ratios set for the first output.

In some embodiments, a mass of the gas used in the reaction or collision cell is no greater than a band-pass width defined by the filter range of mass-to-charge ratios. This mass may be the atomic mass where the component in the adduct is an atom, such as a H or O atom, as in A-H or A-O. In other cases, the mass could be the mass of a molecular fragment, such as NH as in A-NH where ammonia gas is used. Then, an upper bound of the updated first analysis range of mass-to-charge ratios may be lower than an upper bound of the first analysis range of mass-to-charge ratios set for the first output. Additionally or alternatively, this may be understood as the at least one parameter in respect of the updated first output is different from the corresponding parameter of the first output comprising a band-pass width defined by the mass filter that is adjusted by a small increment. For example, if a mass of the reaction gas is higher than the band-pass width defined by the mass filter, the adjustment of the band-pass width may be to higher masses. If a mass of the reaction gas is not higher than the band-pass width defined by the mass filter, the adjustment of the band-pass width may be to lower masses. The difference between a bound of the updated first analysis range of mass-to-charge ratios and a corresponding bound of the first analysis range of mass-to-charge ratios set for the first output (or alternatively, the small increment specified above) is preferably less than 1 amu, 0.5 amu and more preferably less than 0.4, 0.3, 0.25, 0.2 or 0.1 amu. Additionally or alternatively, the at least one parameter in respect of the updated first output that is different from the corresponding parameter in respect of the first output comprises one or both of: a main constituent of the reaction gas; and an isotopic purity of the reaction gas.

Some more details regarding the mode of operation of the elemental (ICP) mass spectrometer are now discussed and in particular, the reaction cell (Q2). A variety of gases may be introduced into the reaction cell 60, but all of them are typically able to produce product ions of the pre-selected precursor ions. It is particularly desirable that, based on the thermodynamic and/or chemical properties of the ions, only the pre-selected ions should undergo a reaction (and therefore a change in the respective m/z ratio). Other ions (interferences), should not undergo a reaction and therefore to not show an increase of their mass. This allows the mass analyzer (Q3) to be set to the m/z ratio of the product ion, this m/z ratio being different from that of the corresponding precursor ion. This can dramatically reduce potential isobaric, polyatomic interferences and thus lower the Background Equivalent Concentrations (BECs). In turn, this allows lowest limits of detection and quantification (LOD/LOQ) to be achieved, even if the sensitivity of the systems in this mode is also reduced. A number of examples in line with this approach are now considered, with reference to the embodiment of FIG. 1, which will be referred to as an ICP-MS below.

A first example is the quantification of sulfur on various matrices. Sulfur has four isotopes, which can be used for quantification by ICP-MS. However, obtaining the best LOD may be hampered by the natural abundance of these isotopes. The most abundant isotope (95.02%), having a nominal m/z ratio of 32, is strongly interfered by positively charged molecular oxygen, for example. Therefore, researchers have previously often used the isotope having a m/z ratio of 34 (4.21% abundant) for their analysis, but interferences like $^{16}O^{18}O^{+}$ can also occur here, leading to high BECs and false positive results.

The quantification of sulfur is extremely desirable, as it is one of the few hetero-atoms inside proteins. In order to determine the nature of a protein (based on its retention time) as well as its amount inside a sample, the ICP-MS system is often coupled to an initial separation device, such as a liquid chromatography (LC) or an ion chromatography (IC) system. As only a very small amount can be separated on the utilized columns, the quantity of ions reaching the analyzer of the ICP-MS system after desolvation, evaporation, atomization and ionization is also limited. As the samples are typically from a biological source, the matrix is quite complex, so that several other components elute from the separation device at the same retention time, while elements occurring in the atmosphere and especially argon, which is used to sustain the plasma, are generally always present. Using an ICP triple quadrupole mass spectrometer can improve the analysis significantly.

Figure 5:
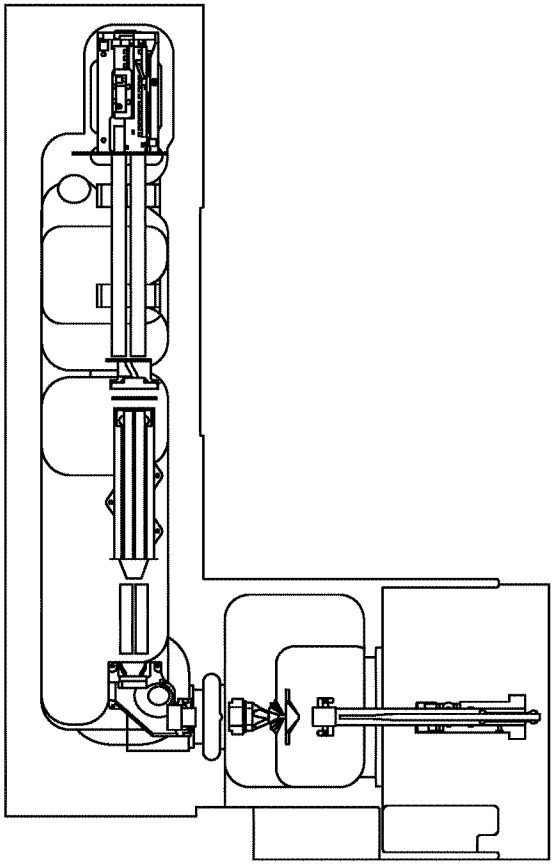
FIG. 5 shows schematically a principle of operation of the ICP mass spectrometer of FIG. 1, for the interference-free quantification of sulfur.
Figure 5:
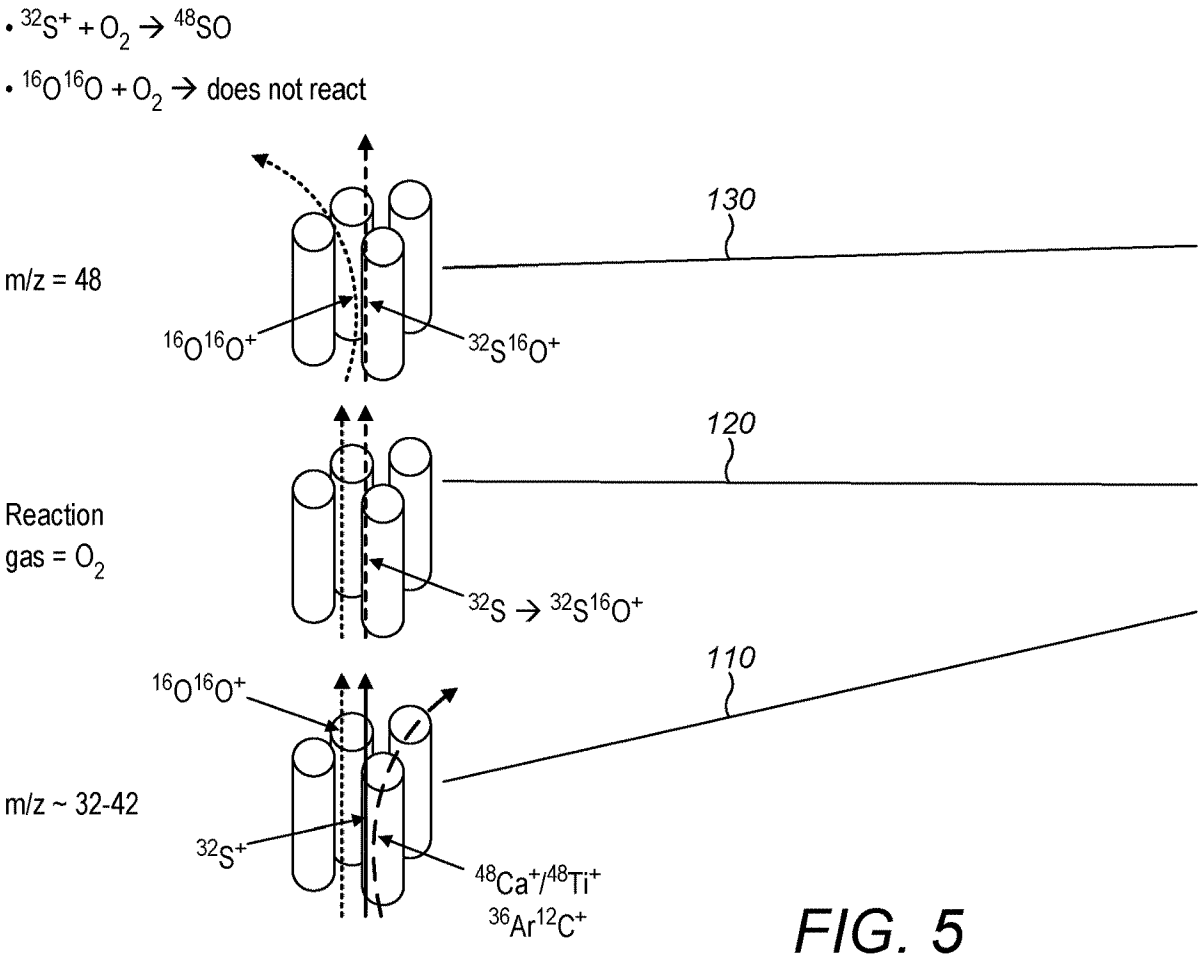

Referring to FIG. 5, there is shown schematically a principle of operation of the ICP mass spectrometer of FIG. 1, for the interference-free quantification of sulfur. In the first mass filter 50, which is a quadrupole device (Q1), only ions having an m/z value of at least 32 are selected, while ions with other masses (such as 48) are filtered out of the ion beam. This is shown in step 110. Thus, the ion beam, in a rough estimation, only comprises sulfur (in this case the most abundant isotope can be used) and other isobaric interferences before it enters the collision or reaction cell 60, in step 120. For such an application, the cell is pressurized with oxygen. Sulfur ions react with oxygen in an exothermic reaction, forming $^{32}S^{16}O^{+}$ with an m/z value of 48. Molecular oxygen ions with the same m/z as $^{32}S$ are not able to undergo this reaction, as energy would be needed (endothermic). Accordingly, after the collision or reaction cell 60, the ion beam comprises: the interferences with m/z 32; sulfur ions that did not undergo a reaction (the sensitivity of the system may be lower in case a mass shift mode is used, for at least this reason); and positively charged sulfur oxide with an m/z of 48. All other interferences with an m/z of 48 were filtered out from the ion beam inside the first quadrupole. Therefore, the sulfur may be analyzed free from interferences, when the second mass filter 80, which is also a quadrupole device (Q3), is set to m/z 48 (the mass of the product ion) in step 130. Alternatively, the second mass filter 80 (Q3) may be set to an m/z value of 64. In this case, only $^{32}S^{16}O^{16}O^{+}$ would contribute to the obtained signal.

Another example is the quantification of titanium in matrices like blood. Titanium, or more concretely titanium alloys are used as material for hip prostheses. Where a so-called metal on metal (MoM) implant is used, the material may not have fixated correctly or loosens with time. In this case, the titanium is exposed to the blood stream and the titanium content in the blood may be analyzed, to see if the prostheses needs to be replaced or not.

Similar to sulfur, titanium has several isotopes, which can be used for quantification. In this case, the isotope having a m/z ratio of 48 is the most abundant and normally strongly interfered by either calcium or doubly charged zirconium. Again, only ions within a well-defined m/z ratio range are allowed to pass the first mass filter 50 (Q1), while in case of titanium, the utilization of ammonia to pressurize the collision or reaction cell 60 gives the best results. While pure oxygen or mixtures with inert gases like argon, xenon or helium can only lead to a limited set of product ions (mono-and dioxide ions), ammonia is able to generate a variety of possible product ions. The specific product ion that are formed strongly depends on the ion kinetic energies and thus on the settings of the ion lenses within the ICP-MS system, predominantly the bias voltages applied to the collision or reaction cell 60 and the second mass filter 80 (Q3). The table below summarizes the possible mass differences according to the number of nitrogen and hydrogen atoms.

| Number | Mass difference | #N | #H | Example | Sum Formula |
|---|---|---|---|---|---|
| 1 | 15 | 1 | 1 | Ti, Os, Ir | NH |
| 2 | 16 | 1 | 2 | Ge | NH2 |
| 3 | 17 | 1 | 3 | — | NH3 |
| 4 | 32 | 2 | 4 | Ti | NH(NH3) |
| 5 | 33 | 2 | 5 | — | NH2(NH3) |
| 6 | 34 | 2 | 6 | Cu, Pt, Au | (NH3)2 |
| 7 | 49 | 3 | 7 | Ti | NH(NH3)2 |
| 8 | 50 | 3 | 8 | — | NH2(NH3)2 |
| 9 | 51 | 3 | 9 | Ti | (NH3)3 |
| 10 | 66 | 4 | 10 | Ti | NH(NH3)3 |
| 11 | 67 | 4 | 11 | Ti | NH2(NH3)3 |
| 12 | 68 | 4 | 12 | Ti | (NH3)4 |
| 13 | 83 | 5 | 13 | Ti | NH(NH3)4 |
| 14 | 84 | 5 | 14 | Ti | NH2(NH3)4 |
| 15 | 85 | 5 | 15 | Ti | (NH3)5 |
| 16 | 100 | 6 | 16 | Ti | NH(NH3)5 |
| 17 | 101 | 6 | 17 | Ti | NH2(NH3)5 |
| 18 | 102 | 6 | 18 | Ti | (NH3)6 |

Figure 6A:
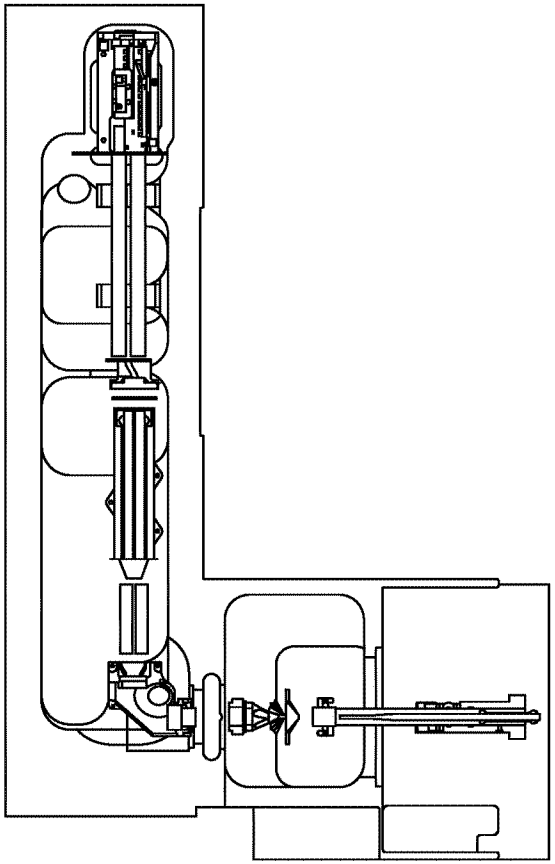
FIGS. 6A and 6B schematically show principles of operation of the ICP mass spectrometer of FIG. 1, for the interference-free quantification of titanium.
Figure 6A:
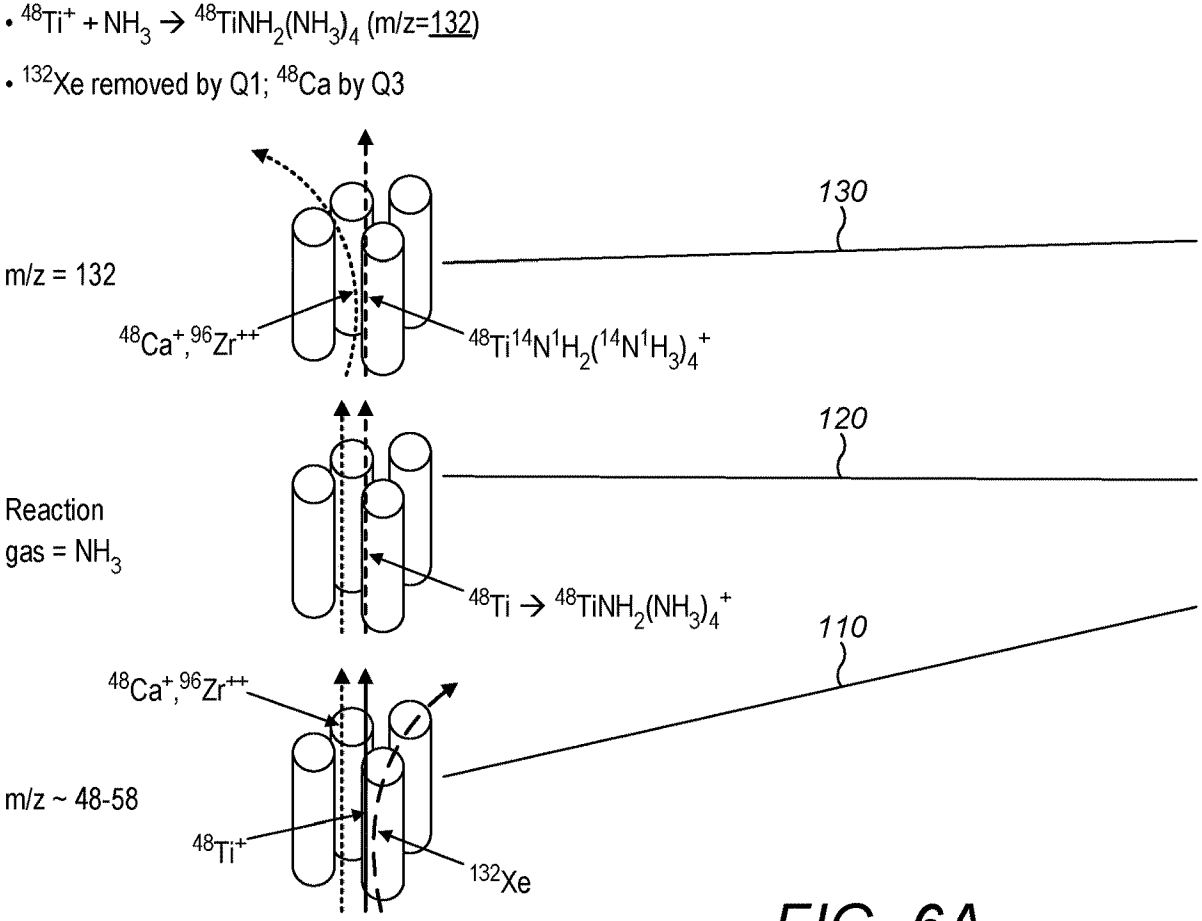
Figure 6B:
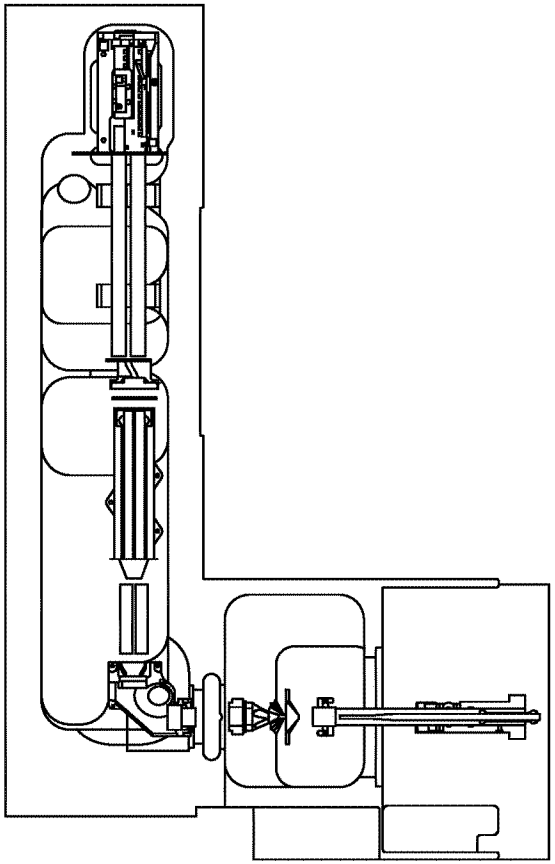
Figure 6B:
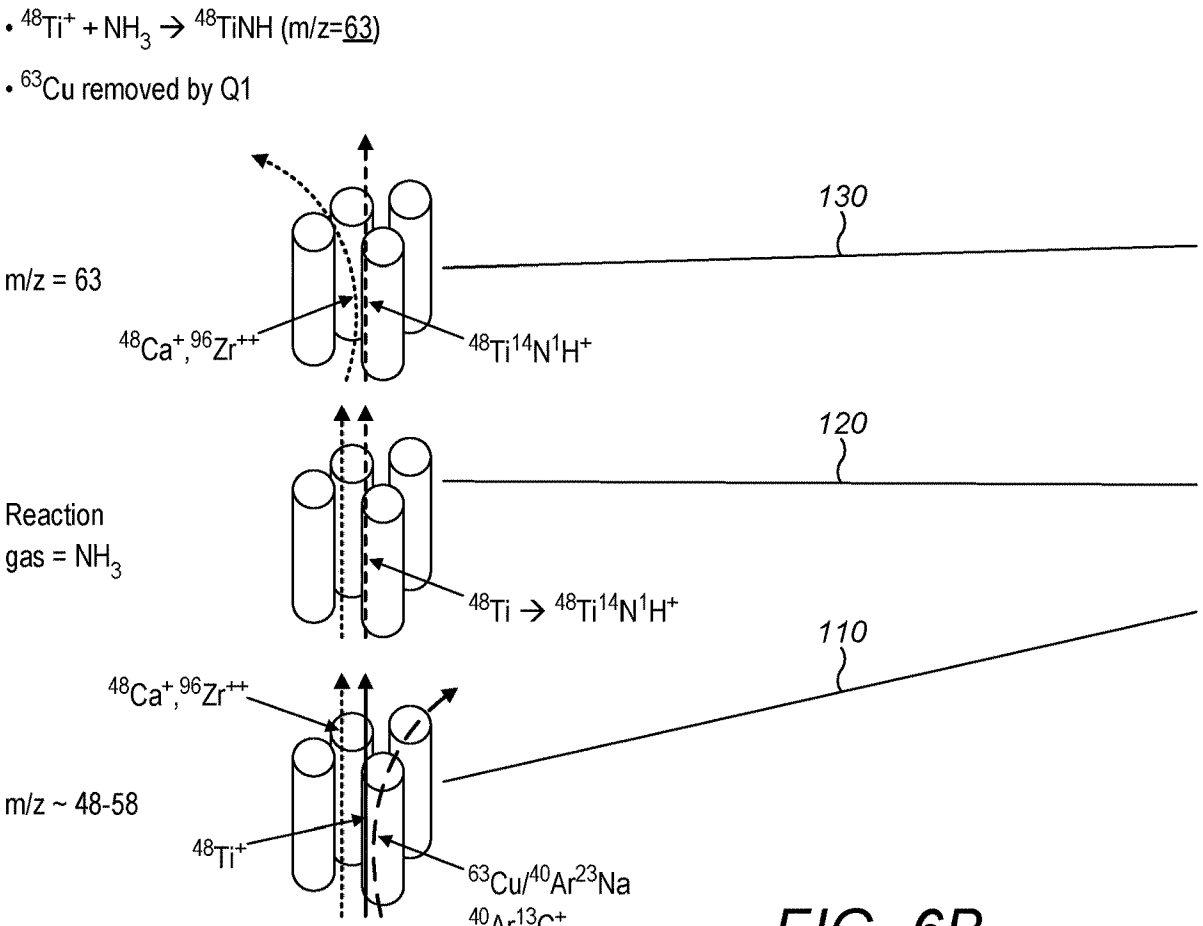

It is noted that for this calculation, the assumption was made that both of these elements are mono-isotopic. This appears valid when looking at the abundances of ions having m/z ratios of 15 (NH), 16 ($NH_2$) and 17 ($NH_3$). It can be seen the abundance values for each of these molecules are greater than 99%, indicating that they can be treated as monoisotopic. From literature, it is known that osmium and iridium form adduct ions with a mass shift of 15 amu, germanium with 16 amu, copper, platinum and gold with 34 amu and titanium with 66 amu. However, a mass shift of 32 amu has also been reported. In FIGS. 6A and 6B, there are shown schematically principles of operation of the ICP mass spectrometer of FIG. 1, for the interference-free quantification of titanium. These are in with the sulfur example described above and the principle can be understood with reference to that description.

As stated above, a variety of applications can be found where an instrument of the type shown in FIG. 1 (such as an ICP triple quadrupole mass spectrometer) shows superior results compared to a conventional system. The most relevant mass-shift reactions are oxidation, that is using a collision or reaction cell 60 pressurized with oxygen. All elements of the periodic table can be categorized into three groups: those where a reaction with oxygen is possible without adding external energy (an exothermic reaction); those where oxidation is possible if the ions possess enough energy due to the bias voltage of the collision or reaction cell 60 (low energy barrier endothermic reaction with bias potential adding three times more energy than needed); and those for which no oxidation possible as energy barrier is too high (strong endothermic reaction). However, where no oxidation reaction can be used to separate the product ion of the analyte from the interferences, other reaction gases can be used. As mentioned above, reactions with ammonia have been reported for copper, platinum, gold, titanium, iridium, osmium and germanium, for instance. A third widely used gas for this purpose is hydrogen. The most prominent examples are the hydrogenation of chlorine ions to $ClH_2^{+}$ and the hydrogenation of phosphorus to $PH_4^{+}$. It has to be noted that in this case the mass difference between precursor ion and product ion is 1 to 4 amu.

Calculation of the maximum width of the mass window and the needed mass window position will now be discussed. As can be seen from the examples above, the mass shift of a precursor ion is at least 16 amu for oxygen or 15 amu for ammonia. This means that the mass window of the first mass filter 50 (Q1) can start from the mass of the precursor ion, that is, the original mass of the analyte m, and can end at m+14 amu. All ions having a mass in the range [m, m+14] will at least gain 15 or 16 amu so that the analyte product ion can be separated by the second mass filter 80 (Q3) from all interferences.

Figure 7A:
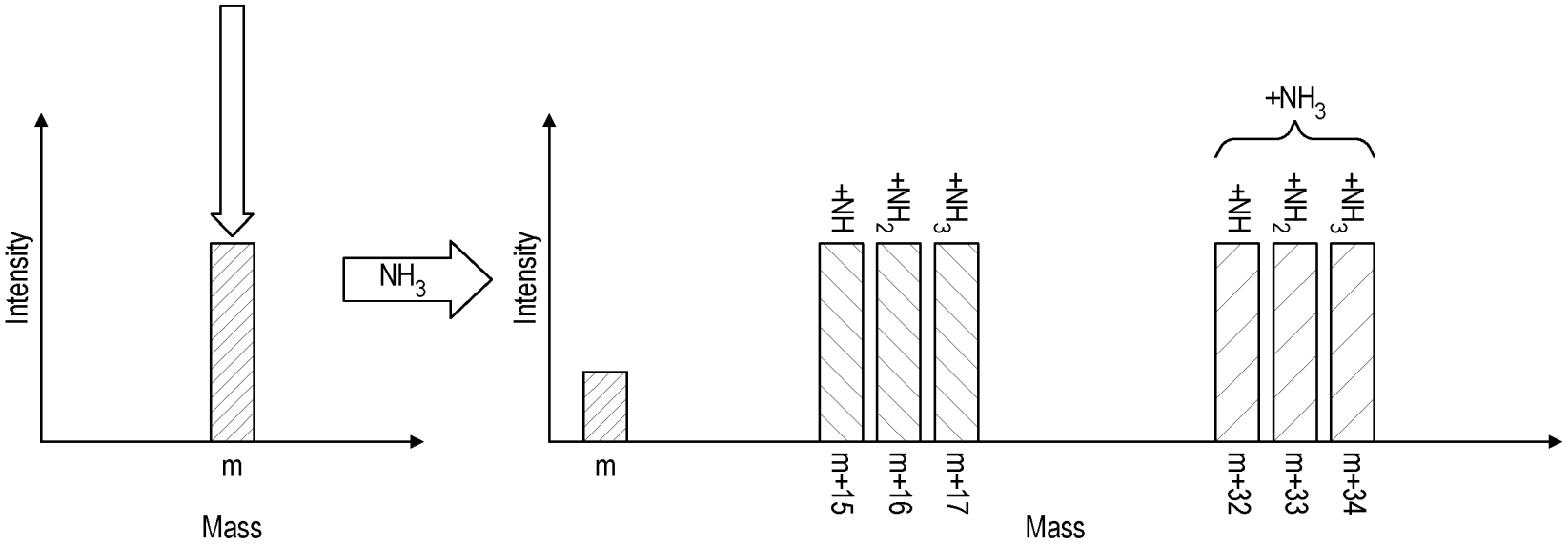
FIGS. 7A, 7B and 7C depict schematic, simplified mass spectra for scenarios in which ions of one or more m/z ratio react with ammonia, dependent on the width of a first mass filter in a mass spectrometer in accordance with FIG. 1.
Figure 7B:
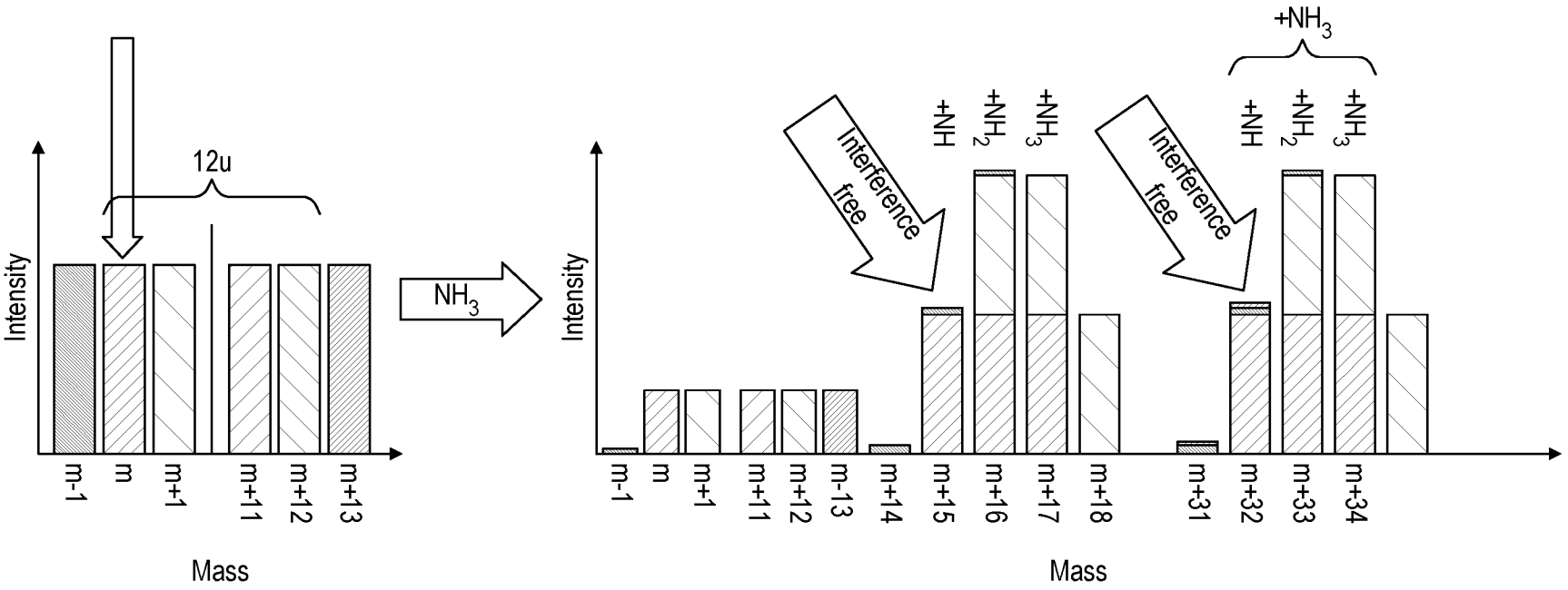

However, as ammonia is able to form more complex clusters, this assumption may not be completely valid. With this in mind, reference is now made to FIGS. 7A to 7C, in which there is depicted schematic, simplified mass spectra for scenarios in which ions of one or more m/z ratio react with ammonia, dependent on the width of a first mass filter in a mass spectrometer in accordance with FIG. 1. Referring first to FIG. 7A, there is shown an exemplary mass spectrum, if only one ion with one certain mass (m) reacts with ammonia. It can be seen that peaks at m+15, m+16, m+17, m+32, m+33 and m+34 may be seen. FIG. 7B depicts a mass spectrum for a similar situation in which more masses are added. This occurs because the first mass filter 50 (Q1) has a larger mass window width of 12 amu, as shown on the left-hand side of this diagram. The analyte mass is located at the low mass side of the Q1 mass window. Due to the first mass filter 50, the mass spectrum of ions after the reaction cell 60 includes relatively very small intensities at mass m−1 and at masses m+13 and m+14. The contribution of interferences can be removed, as discussed above. It should be noted that, for the purposes of this illustration, it is assumed that all ions show the same reaction efficiency, which is not true for all applications. It can be seen from this example that a maximum mass window width of 12 amu is needed in order to analyze product ions at m+32 amu free from interferences. However, only product ions falling into the class ($m+NH(NH_3)_n$), whereby n is a natural number including 0, can be analyzed.

Figure 7C:
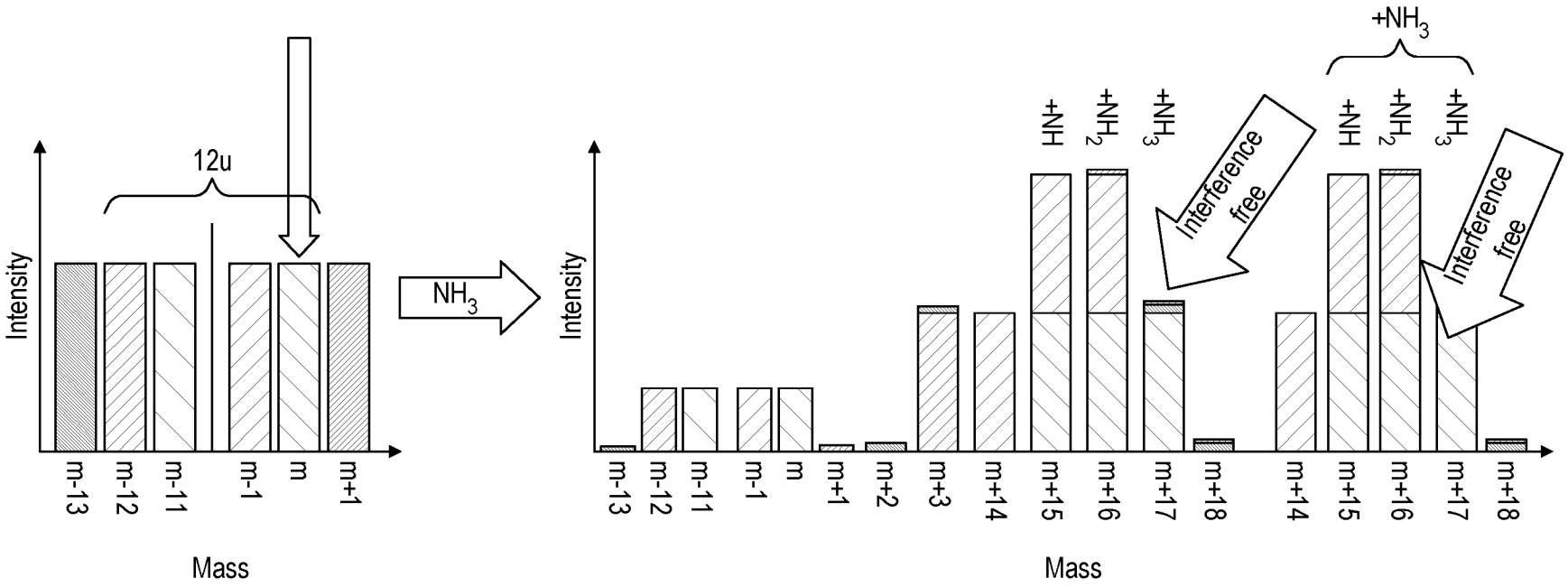

In order to analyze ions falling into the class $(m+(NH_3)_{n+i})$ as well, the analyte mass should be shifted to the high mass side of the mass window. FIG. 7C depicts a mass spectrum for a similar situation as FIG. 7B, in which the first mass filter 50 (Q1) has a mass window width of 12 amu, as shown on the left-hand side of this diagram. The center mass of the mass window is the same. The only difference is the position of the precursor mass of interest within the mass window. The analyte mass is located at the high mass side of the Q1 mass window.

As discussed above, shifting the position of the mass window around the precursor mass of interest is also the solution to issues with the aforementioned reactions with hydrogen. Here, the mass difference between the precursor ion mass and the product ion mass is between 1-4 amu. In this case, the precursor ion mass also needs to be located at the high mass side of the mass window created by the first mass filter 50 (Q1). For the two mentioned examples, none of the ions having a lower mass than chlorine or phosphorus is able to produce clusters having more hydrogen atoms than the product ion. This means that even if new ions are created inside the collision or reaction cell 60, none of these product ions will have a mass of 35 amu (where $^{31}P^+$ is the precursor ion) or 37 u (where $^{35}Cl^+$) is the precursor ion. The precise quantification of phosphorus can be important for the semiconductor industry for example, in order to use only the cleanest chemicals and verify the amount of doping in a silicon wafer.

The quality of the low and high mass suppression will now be considered, with reference to the mass window of the first mass filter 50 (Q1). As can be seen in FIGS. 7B and 7C, ions having a mass of 1 amu less than the lowest mass inside the mass window or 1 amu higher than the highest mass inside the mass window should be suppressed, in order not to create unwanted product ions having the same m/z ratio value as the product ion of interest.

Where the reaction cell 60 carries out an oxidation reaction, the quality of the suppression may be defined by assuming the same reaction efficiency for all ions and calculating the quantity of interfering ions due to reactions with the low abundance isotopes of oxygen $^{17}O$ (0.038%) and $^{18}O$ (0.2%). If the abundance sensitivity of the whole system is also included as the product of the single abundance sensitivity values, it can be seen that for a false positive signal of 3%, the interfering signal can be 5,000 times more intense than the analyte. This may be achieved if the mass window suppresses masses at m−1 and m+13 (in case of low mass suppression) or m−13 and m+1 (in case of high mass suppression) to 1%, that is by a factor of 100. This means that if the mass separation power of the first mass filter 50 (Q1) is not sufficient to provide a steep enough slope for the mass window peak flanks, the working point (desired mass) may be inside the flank of the peak in practice. This would potentially lower the obtainable sensitivity of the instrument, but may still guarantee sufficient interference suppression. A further point should be noted, however. In order to obtain not only accurate, but also precise results, the interference suppression quality must be kept constant over a longer period of time.

Some other examples and "on mass" applications will now be discussed. The utilization of a quadrupole as the first mass filter 50 has some other additional benefits, apart from those already mentioned. The skilled person will appreciate that such a quadrupole device does not necessarily be driven as a mass filter. It can additionally or alternatively act as an ion guide with the ability to cut-off low mass ions when the applied radio frequency voltage is increased with the mass of the analyte.

Advantages can also be gained if the set mass of the first quadrupole is the same as the set mass of the third quadrupole. For instance, abundance sensitivity may be improved. For example, when analyzing bromine at its 81 amu isotope, the peak at an m/z ratio 80 ($^{40}Ar^{40}Ar$) may contribute to the signal at m/z 81 due to tailing. In this case, the first quadrupole might be beneficial as the so-called abundance sensitivity is increased either to the low mass side or to the high mass side, depending on the position of the mass window. However, applications for this might be limited as most ions undergo a single hydrogenation reaction, simply shifting a portion of the peak with the high abundance on the mass of the analyte of interest. Moreover, as the number of ions inside the ions beam is limited after the first quadrupole, reduced space charge effects and thus a flatter mass bias over the whole mass range of the interest are also beneficial. This allows the use of this instrument as a normal or advanced quadrupole mass spectrometer.

The instrument can also be configured such that the reaction cell 60 does not cause the mass of the analyte to be shifted, but rather the mass of the interfering ions. This means that from the set of selected precursor ions, the analyte ions do not react, but the interfering ions do react. As discussed above, this has been reported for some applications in the field of rare earth elements and is also well known from earlier ICP-MS systems, where a mass shift of the interference is used for the quantification of selenium or iron. The two most abundant isotopes of these elements (80, 56 amu, respectively) are strongly interfered by $^{40}Ar^{40}Ar^+$ and $^{40}Ar^{16}O^+$. In both cases, hydrogen or mixtures of hydrogen with inert gases are used to "discharge" the interferences or create product ions with hydrogen. The reaction efficiency of iron and selenium ions with hydrogen is quite low so that in this case both quadrupole are set to the respective same mass again.

As explained above, a motivation for the present invention relates to the parameters of the first (Q1) mass filter 50, in particular allowing this mass filter to transmit ions with an m/z ratio range greater than 1 amu. The first mass filter 50 is typically a multipole ion optics device and preferably a quadrupole device. The speed of the ions through this device can be controlled using the axis potential (also named an offset potential), with an increased potential leading to slower ions and higher mass filtering properties. An increased axis potential (particularly a positive axis potential) may also cause reduced transmission through the device, however. It has been found that a good compromise between resolution and transmission for the first mass filter 50 can be achieved with an axis potential that is around 0V. The exact axis potential may depend on the transmitted m/z ratio range. Analysis of the ions in a current ICP-MS analyzer suggests an average energy of slightly more than 1 eV, with a FWHM (full width at half maximum) of around 5 eV.

The slope of the transmission window for the first mass filter 50 is another parameter for consideration. Typically, an intensity slope of at least $10^{2.5}$/amu at the edge of the transmission window (equivalent to a suppression of a neighbouring mass to less than 1%) is acceptable and a greater slope is preferred. This is especially the case when the desired m/z ratio is close to the edge of the transmission window (that is no more or less than 1 amu away from the edge). The number of oscillations may be half of the oscillations of the second (Q3) mass filter 80. In particular embodiments, the product of the length of the first mass filter 50 and its oscillation frequency should be around (or no more than) $2*10^5$ Hz*m and alternatively, around (or no more than) $2.5*10^5$ Hz*m, $3*10^5$ Hz*m, $3.5*10^5$ Hz*m, $4*10^5$ Hz*m, $4.5*10^5$ Hz*m, $5*10^5$ Hz*m or $5.5*10^5$ Hz*m.

In general terms, another aspect may be considered as an elemental mass spectrometer, comprising: an ion source for generating ions; a (multipole, preferably quadrupole) mass filter, arranged to receive ions generated by the ion source, to select ions of a filter range of mass-to-charge ratios from the received ions and to transmit the selected ions; a reaction or collision cell, configured to receive ions transmitted by the mass filter and to react the received ions with a gas and provide or generate product ions thereby; and a mass analyzer, arranged to receive the product ions from the reaction or collision cell and analyze the received ions within one or more analysis ranges of mass-to-charge ratios. The mass filter may be configured such that a product of a length of the mass filter and its oscillation (RF) frequency is no more than one of: $2*10^5$ Hz*m, $2.5*10^5$ Hz*m, $3*10^5$ Hz*m, $3.5*10^5$ Hz*m, $4*10^5$ Hz*m, $4.5*10^5$ Hz*m, $5*10^5$ Hz*m; and $5.5*10^5$ Hz*m. Additionally or alternatively, any other of the parameters (or parameter ranges) disclosed herein with reference to the (first) mass filter may be used. The reaction or collision cell and/or the mass analyzer may also be a multipole (preferably quadrupole) ion device. In addition, this general aspect may be optionally combined with any other features disclosed herein with respect to other aspects.

The first mass filter 50 is further configured such that each ion undergoes a minimal number of collisions with gas molecules. Such collisions reduce the transmission. Preferably, each ion should undergo no more than one collision within the quadrupole. This can be achieved even if the first mass filter 50 is operated in the same pressure region as the reaction cell 60 (a pressure difference of no more than 10%, 20% or 25%). In this case, it is desirable that the length of the first mass filter 50 be short, preferably in the order of 50 mm and typically no more than (or less than) one of: 100 mm; 90 mm; 80 mm; 75 mm; 70 mm; 60 mm; and 50 mm. Additionally or alternatively, the length of the first mass filter 50 may be no more than half the length of the second (Q3) mass filter 80.

Based on the above analysis, the RF frequency applied to the first mass filter 50 can be calculated. If the product of the mass filter length and its RF frequency is $2.5*10^5$ Hz*m and the length is 50 mm, the RF frequency should be 4 MHz. In practice, the RF frequency may be higher than this, as a higher frequency may be advantageous. For example, a length of the mass filter may no more than 40 mm, 50 mm, 60 mm or 70 mm and/or an oscillation or RF frequency of the mass filter may at least 3, 3.5, 4, 4.5, 5 MHz. Additionally or alternatively, the RF frequency of the first mass filter 50 may be no more than 1.5 or 2 times the RF frequency of the second (Q3) mass filter 80. Taking these parameters into account, the size parameter for the quadrupole, $r_0$, should be 2, 3 or 4 mm.

Introduction ion optics are preferably provided, configured to interface the ion source and the mass filter. The introduction ion optics and the mass filter are optionally configured to operate at substantially the same pressure (within a tolerance of 1%, 2%, 3%, 4%, 5% or 10%). Although this may result in sub-optimal performance of the mass filter, the overall degradation to the output may be mitigated by the disclosed invention. Moreover, operating the introduction ion optics and the mass filter may be significantly less complex and/or expensive to implement than differential pressures between these parts.

Although a specific embodiment has been described, the skilled person will appreciate that various modifications and alternations are possible. For example, the structure of the elemental mass spectrometer may vary, with different types of ion source, interface structure and optics, introduction ion optics (for example which may not necessary require deflection) and/or differential pumping arrangements. Other configurations of the system are possible, in which components are combined or differently implemented. Alternatives for the Q3 mass filter or analyzer 80 may include a monopole device, a linear or three-dimensional RF trap, an ion mobility filter, a time-of-flight or distance-of-flight mass selection device, an electrostatic trap (such as an orbital trapping mass analyzer), a magnetic sector or other mass selection or analysis device. In fact, the Q3 stage may comprise multiple mass selection or analysis devices, in sequence or parallel. Optionally, the Q3 mass filter 80 may have a band-pass width greater than 1 amu. A threshold of 80% for a share in the total signal was considered above, but any other threshold could be chosen, such as 30%, 50%, 90% or others. Though the description above typically implies singly-charged ions, the invention is also applicable to multiply-charged ions.

The examples described above employ a polyisotopic reaction gas. However, the skilled person will understand that additionally or alternatively, the ions being analyzed and/or the interference ions may be polyisotopic. The principles described herein can be employed with appropriate adaptation.

It will therefore be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" (such as an analogue to digital convertor) means "one or more" (for instance, one or more analogue to digital convertor). Throughout the description and claims of this disclosure, the words "comprise", "including", "having" and "contain" and variations of the words, for example "comprising" and "comprises" or similar, mean "including but not limited to", and are not intended to (and do not) exclude other components.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

The invention claimed is:

1. An elemental mass spectrometer, comprising:

an ion source for generating ions;

a mass filter, arranged to receive ions generated by the ion source, to select ions of a filter range of mass-to-charge ratios from the received ions and to transmit the selected ions;

a reaction or collision cell, configured to receive ions transmitted by the mass filter and to react or collide the received ions with a gas and provide product ions thereby;

a mass analyzer, arranged to receive the product ions from the reaction or collision cell, to analyze the received ions within one or more analysis ranges of mass-to-charge ratios and to provide at least one output based on detection of the analyzed ions; and a controller, configured to operate the elemental mass spectrometer, so as to provide a first output from the mass analyzer measuring ions within a first analysis range of mass-to-charge ratios to provide a second output from the mass analyzer measuring ions within a second analysis range of mass-to-charge ratios and to correct the first output for interference on the basis of the second output, and the controller is further configured to:

to determine an interference level based on the second output;

to identify if the interference level relative to the first output is at least a threshold level, and if the threshold level is met, to operate the elemental mass spectrometer, so as to provide an updated first output, at least one parameter in respect of the updated first output being different from a corresponding parameter of the first output; and wherein the controller is configured to correct the first output by correcting the updated first output on the basis of the second output.

2. The elemental mass spectrometer of claim 1, wherein the filter range of mass-to-charge ratios is wider than 1 atomic mass unit.

3. The elemental mass spectrometer of claim 1, wherein each of the one or more analysis ranges of mass-to-charge ratios is no wider than 1 atomic mass unit, the first output being provided by a first operation of the elemental mass spectrometer with the mass analyzer configured to analyze received ions within the first analysis range of mass-to-charge ratios and the second output being provided by a second operation of the elemental mass spectrometer with the mass analyzer configured to analyze received ions within the second analysis range of mass-to-charge ratios.

4. The elemental mass spectrometer of claim 1, wherein the mass analyzer is arranged to perform a single analysis of the received ions within a range of mass-to-charge ratios having a width of at least 1 atomic mass unit, the first output and second output being provided on the basis of the single analysis.

5. The elemental mass spectrometer of claim 1, wherein the first analysis range includes a desired mass to charge ratio, M, and the second analysis range includes a mass to charge ratio at least 0.95 atomic mass units lower than the desired mass to charge ratio, (M-i), i>0.95, and wherein the controller is further configured to operate the elemental mass spectrometer, so as to provide a third output measuring ions within a third analysis range of mass-to-charge ratios including a mass-to-charge ratio at least 0.95 atomic mass units lower than the desired mass-to-charge ratio, (M-i), i>0.95, the third analysis range of mass-to-charge ratios being different from the second analysis range of mass-to-charge ratios, the controller being further configured to correct the first output on the basis of the second output and the third output.

6. The elemental mass spectrometer of claim 1, wherein the first analysis range includes a desired mass to charge ratio, M, and the second analysis range includes a mass to charge ratio at least 0.95 atomic mass units lower than the desired mass to charge ratio, (M-i), i>0.95, and wherein the updated first output measures ions within an updated first analysis range of mass-to-charge ratios including the desired mass-to-charge ratio, M, but is different from the first analysis range of mass-to-charge ratios used for the first output.

7. The elemental mass spectrometer of claim 6, wherein a lower bound of the updated first analysis range of mass-to-charge ratios is higher than a lower bound of the first analysis range of mass-to-charge ratios.

8. The elemental mass spectrometer of claim 6, wherein a mass of the gas used in the reaction or collision cell is no greater than a band-pass width defined by the filter range of mass-to-charge ratios, an upper bound of the updated first analysis range of mass-to-charge ratios being lower than an upper bound of the first analysis range of mass-to-charge ratios.

9. The elemental mass spectrometer of claim 6, wherein the difference between a bound of the updated first analysis range of mass-to-charge ratios and a corresponding bound of the first analysis range of mass-to-charge ratios is less than 0.5 atomic mass units.

10. The elemental mass spectrometer of claim 1, wherein the at least one parameter in respect of the updated first output is different from the corresponding parameter of the first output comprises a band-pass width defined by the mass filter that is adjusted by a small increment.

11. The elemental mass spectrometer of claim 10, wherein a mass of the reaction gas is higher than the band-pass width defined by the mass filter and the adjustment of the band-pass width is to higher masses.

12. The elemental mass spectrometer of claim 10, wherein a mass of the reaction gas is not higher than the band-pass width defined by the mass filter, and the adjustment of the band-pass width is to lower masses.

13. The elemental mass spectrometer of claim 1, wherein the at least one parameter in respect of the updated first output that is different from the corresponding parameter of the first output comprises one or both of: a main constituent of the reaction gas; and an isotopic purity of the reaction gas.

14. The elemental mass spectrometer of claim 1, further comprising:

introduction ion optics, configured to interface the ion source and the mass filter; and wherein the introduction ion optics and the mass filter are configured to operate at substantially the same pressure.

15. The elemental mass spectrometer of claim 1, wherein one or more of the mass filter, reaction or collision cell and the mass analyzer comprise a respective monopole or multipole ion optical device.

16. The elemental mass spectrometer of claim 15, wherein the multipole ion optical device is one of: a quadrupole; a hexapole; and an octapole.

17. The elemental mass spectrometer of claim 1, wherein the ion source comprises an Inductively Coupled Plasma, ICP, torch, a Glow Discharge source or a Microwave Induced Plasma, MIP, source.

18. The elemental mass spectrometer of claim 1, wherein the mass analyzer comprises:

a mass selection device, configured to select ions of the one or more analysis ranges of mass-to-charge ratios from the received product ions and to transmit the selected ions; and an ion detector, arranged to detect ions transmitted by the mass selection device.

19. The elemental mass spectrometer of claim 1, wherein the mass analyzer comprises a time-of-flight or distance-of-flight mass analyzer, a magnetic sector, an RF trap, an electrostatic trap analyzer or an orbital trapping mass analyzer.

20. A method of operating an elemental mass spectrometer, comprising:

generating ions in an ion source;

selecting ions of a filter range of mass-to-charge ratios from the ions generated by the ion source, at a mass filter, and transmitting the selected ions;

reacting or colliding ions transmitted by the mass filter with a gas at a reaction cell, to provide product ions thereby;

analyzing the product ions within a plurality of analysis ranges of mass-to-charge ratios, at a mass analyzer, so as to provide a first output measuring ions within a first analysis range of mass-to-charge ratios and to provide a second output measuring ions within a second analysis range of mass-to-charge ratios; and correcting the first output for interference on the basis of the second output, wherein correcting the first output includes:

determining an interference level based on the second output;

identifying if the interference level relative to the first output is at least a threshold level;

providing an updated first output if the threshold level is met, at least one parameter in respect of the updated first output being different from a corresponding parameter of the first output; and correcting the first output by correcting the updated first output on the basis of the second output.

21. The method of claim 20, wherein the filter range of mass-to-charge ratios is wider than 1 atomic mass unit.

22. The method of claim 20, wherein each of the one or more analysis ranges of mass-to-charge ratios is no wider than 1 atomic mass unit, the first output being provided by a first operation of the elemental mass spectrometer with the mass analyzer configured to analyze received ions within the first analysis range of mass-to-charge ratios and the second output being provided by a second operation of the elemental mass spectrometer with the mass analyzer configured to analyze received ions within the second analysis range of mass-to-charge ratios.

23. The method of claim 20, wherein the mass analyzer is arranged to perform a single analysis of the received ions within a range of mass-to-charge ratios having a width of at least 1 atomic mass unit, the first output and second output being provided on the basis of the single analysis.

24. The method of claim 20, wherein the first analysis range includes a desired mass to charge ratio, M, and the second analysis range includes a mass to charge ratio at least 0.95 atomic mass units lower than the desired mass to charge ratio, (M-i), i>0.95, and further comprising:

providing a third output measuring ions within a third analysis range of mass-to-charge ratios including a mass-to-charge ratio at least 0.95 atomic mass units lower than the desired mass-to-charge ratio, (M-i), i>0.95, the third analysis range of mass-to-charge ratios being different from the second analysis range of mass-to-charge ratios; and correcting the first output on the basis of the second output and the third output.

25. The method of claim 20, wherein the first analysis range includes a desired mass to charge ratio, M, and the second analysis range includes a mass to charge ratio at least 0.95 atomic mass units lower than the desired mass to charge ratio, (M-i), i>0.95, and wherein the updated first output measures ions within an updated first analysis range of mass-to-charge ratios including the desired mass-to-charge ratio, M, but is different from the first analysis range of mass-to-charge ratios used for the first output.

* * * * *